US006626650B1

(12) United States Patent
Kenchington et al.

(10) Patent No.: US 6,626,650 B1
(45) Date of Patent: Sep. 30, 2003

(54) CYCLICALLY OPERATED FLUID DISPLACEMENT MACHINE

(75) Inventors: Steven Kenchington, Norwich (NF); Jeffrey Allen, Attleborough (NF)

(73) Assignee: Lotus Cars Limited, Norfolk (GB)

( * ) Notice: Subject to any disclaimer, the term of this patent is extended or adjusted under 35 U.S.C. 154(b) by 0 days.

(21) Appl. No.: 10/009,103

(22) PCT Filed: Jun. 9, 2000

(86) PCT No.: PCT/GB00/02260

§ 371 (c)(1),
(2), (4) Date: Dec. 7, 2001

(87) PCT Pub. No.: WO00/77366

PCT Pub. Date: Dec. 21, 2000

(30) Foreign Application Priority Data

Jun. 11, 1999 (GB) ..... 9913661

(51) Int. Cl.[7] ..... F04B 17/04; F04B 35/04

(52) U.S. Cl. ..... 417/416; 417/418; 417/546; 123/46 R

(58) Field of Search ..... 417/416, 417, 417/488, 547, 225, 396, 404, 287, 545, 546, 549, 552, 555.1, 561, 419, 487, 418; 123/46 A, 46 E, 46 R

(56) References Cited

U.S. PATENT DOCUMENTS

| | | | | |
|---|---|---|---|---|
| 4,212,597 A | * | 7/1980 | Gali Mallofre | 417/225 |
| 4,449,488 A | * | 5/1984 | Heaton | 124/46 R |
| 4,586,881 A | | 5/1986 | Beshore | |
| 4,775,301 A | * | 10/1988 | Cartwright et al. | 417/417 |
| 5,085,563 A | * | 2/1992 | Collins et al. | 417/417 |
| 5,172,784 A | | 12/1992 | Varela, Jr. | |
| 5,540,194 A | * | 7/1996 | Adams | 123/46 R |
| 5,600,961 A | | 2/1997 | Whipple, III | |
| 5,678,522 A | | 10/1997 | Han | |
| 6,199,519 B1 | | 3/2001 | Van Blarigan | |

FOREIGN PATENT DOCUMENTS

| | | |
|---|---|---|
| DE | 28 32 909 | 2/1980 |
| FR | 2 092 659 | 1/1972 |
| GB | 198735 | 6/1923 |
| GB | 736664 | 9/1955 |
| GB | 2 330 012 | 4/1999 |
| NL | 7806506 | 12/1979 |

OTHER PUBLICATIONS

Peter Van Blarigan, Nicholas Paradiso and Scott Goldsborough Homogeneous Charge Compression Ignition with a Free Piston: A New Approach to Ideal Otto Cycle Performance, 1998 Society of Automotive Engineers, Inc. (Total 18 pages).

* cited by examiner

*Primary Examiner*—Cheryl J. Tyler
*Assistant Examiner*—Han L Liu
(74) *Attorney, Agent, or Firm*—Luedeka, Neely & Graham, P.C.

(57) ABSTRACT

A displacement machine (10) comprises a housing (11), a reciprocating member (12) reciprocable linearly along an axis of reciprocation (13) in the housing (11) and defining with the housing (11) first (14) and second (15) variable volume chambers. A fluid inlet (17) is connected to the first variable volume chamber (14). A fluid outlet (78) is connected to the second variable volume chamber. An inlet value (16) allows flow of fluid through the fluid inlet (17) into the first variable volume chamber (14) and prevents flow of fluid from the first variable volume chamber (14) out of the fluid inlet (17).

36 Claims, 4 Drawing Sheets

PRESSURISED NATURAL GAS
IGNITION AND INJECTION CONTROLLER
ELECTRONIC CONTROLLER

CYCLICALLY OPERATED FLUID DISPLACEMENT MACHINE

The present invention relates to a cyclically operated fluid displacement machine.

The present invention can provide a cyclically operated fluid displacement machine either in the form of an engine or a compressor.

The present invention aims to provide a machine which is very simple and in particular which does not require a valve train system, separate alternator and starter motor or cam shaft. The machine of the present invention could be used as an engine in a hybrid vehicle, the engine producing electrical power which would then be used by electrical motors to power the vehicle.

U.S. Pat. No. 5,172,784 describes an arrangement for powering a hybrid vehicle which comprises external combustion Stirling engines coupled to linear generators and used in conjunction with a battery pack to power electric motors for a vehicle.

U.S. Pat. No. 4,924,956 describes a tandem double-acting free piston engine comprising a housing including a cylinder having first and second combustion chambers at opposite ends thereof and a third combustion chamber between the ends. One double acting piston is displaceable between the first and third combustion chamber. A second double acting piston is displaceable between the second and third combustion chambers. The two double acting pistons are linked so that they move in timed relationship with each other. A linear alternator is combined in the engine by attaching one coil to each of the double acting pistons and by surrounding the cylinder with other electrical coils, the fields of which are intersected by the coils on the two pistons.

The present invention provides a cyclically operated fluid displacement machine which comprises:

a housing;

a reciprocating member reciprocal linearly along an axis of reciprocation in the housing and defining with the housing first and second variable volume chambers;

a fluid inlet connected to the first variable volume chamber;

a fluid outlet connected to the second variable volume chamber;

inlet valve means which allows flow of fluid through the fluid inlet into the first variable volume chamber and which prevents flow of fluid from the first variable volume chamber out of the fluid inlet;

transfer valve means which allows flow of fluid from the first variable volume chamber to the second variable volume chamber and which prevents flow of fluid from the second variable volume chamber to the first variable volume chamber;

outlet valve means which allows flow of fluid from the second variable volume chamber out of the fluid outlet and which prevents flow of fluid from the fluid outlet into the second variable volume chamber; wherein:

during movement of the reciprocating member in the housing in a first direction fluid is drawn into the first variable volume chamber and the fluid in the second variable volume chamber expelled from the second variable volume chamber via the fluid outlet; and during movement of the reciprocating member in the housing in a second direction, opposite to the first direction, fluid is compressed in the first variable volume chamber and fluid is transferred from the first variable volume chamber via the transfer valve means to the second variable volume chamber;

characterised in that:

the reciprocating member comprises a middle section which extends perpendicularly of the axis of reciprocation and two end sections on opposite sides of the middle section, each of the end sections comprising a wall extending generally parallel to the axis of reciprocation and each of the end sections defining with the middle section an open-ended cylinder open at one end;

the housing has a first piston portion which extends into a first of the open-ended cylinders of the reciprocating member and which acts as a piston in the first open-ended cylinder with the first piston portion and the first open-ended cylinder together defining the first variable volume chamber; and the housing has a second piston portion which extends into a second of the open-ended cylinders of the reciprocating member which acts as a piston in the second open-ended cylinder with the second piston portion and the second open-ended cylinder together defining the second variable volume chamber.

The construction of the machine given above provides an engine or a compressor which has a reduced weight at reduced cost and is simple. In effect, the machine has a single moving member. The machine would be ideal, for instance, for use as an engine in a hybrid vehicle.

Preferably, the reciprocating member has a generally circular radial cross-section and the end sections each comprise an annular wall spaced from a central axis of the reciprocating member.

Making the reciprocating member circular in cross-section eases the manufacture of the machine as a whole.

Preferably, an electrical winding is provided in the housing surrounding the reciprocating member, the electrical winding extending parallel to and adjacent to the end-section walls of the reciprocating member.

The present invention can provide a very compact and simple combined machine and electrical power generator. By locating the winding next to the reciprocating member more power and/or greater electrical control is provided. The construction of the engine can allow the greater percentage of the work of the piston in an engine to be extracted and also the construction of machine allows electrical force to be used efficiently to compress gas in a compressor or to compress fuel/air mixture in an engine. Electrical control can also be used to control the position of the reciprocating member accurately.

Preferably, the electrical winding extends parallel to the axis of reciprocation on the reciprocating member and has a length equivalent to at least the sum of the axial length of the reciprocating member and the distance travelled by the reciprocating member in each reciprocation. This ensures good efficiency.

Preferably the end section walls of the reciprocating member are slidable in slots defined in the housing and the electrical winding in the housing extends adjacent to, and parallel with, surfaces defining the slots. Preferably a seal is formed between the end sections of the reciprocating member and the slots in which the end section slides.

In some embodiments resilient means acts between the housing and the reciprocating member to bias the reciprocating member to move in one direction. Preferably the resilient means act to bias the reciprocating member to reduce the second variable volume chamber to a minimum volume.

The reciprocating member in the present machine is essentially a free motion member. In the prior art, free motion pistons have tended to be used in diesel engines or in Stirling engines. In diesel engines combustion could be ensured by the functioning of the diesel cycle. However, the engines tend to be fairly large and bulky. Stirling engines lack the benefit of internal combustion. The resilient means biassing the reciprocal member could comprise a standard coiled spring or a gas spring. The machine could be configured to work at a frequency equivalent to its resonant frequency, e.g. 3000 rpm. The machine could also be operated by pausing the reciprocating member at a convenient point, with the duration of the pause being variable to vary power output.

Preferably, each of the inlet valve means, the outlet valve means and the transfer valve means comprises either a one-way valve which opens and closes under the action of a pressure differential thereacross or a ported valve comprising a port opening onto one of the variable volume chambers which is cyclically opened and closed by the reciprocating member during reciprocation.

The present invention can remove the need for a complicated valve train system. The present invention when used as an engine can combine an alternator and a starter motor by using electrical winding.

The present invention does away with the need for a cam shaft to control movement of valves. The present invention works essentially on a two-stroke cycle when the invention is used as an engine.

Preferably the inlet valve means comprises a spring-biassed one-way valve.

In one embodiment the machine described before functions as an internal combustion engine, wherein:

- a charge of air is drawn into the first variable volume chamber via the fluid inlet;
- the charge of air drawn into the first variable volume chamber is compressed;
- the compressed charge of air is delivered via the transfer valve means to the second variable volume chamber;
- the machine comprises fuel delivery means which delivers fuel to a second variable volume chamber for mixing with the compressed charge of air;
- the compressed charge mixture of fuel and air is combusted and allowed to expand in the second variable volume chamber; and
- the expanded combusted mixture is scavenged from the second variable volume chamber by a subsequent charge of air delivered to the second variable volume chamber via the transfer valve means.

The present invention provides a very simple construction of engine, with essentially only one moving part.

Preferably the fuel used in the engine is compressed natural gas and the machine comprises storage means for storing natural gas in a pressurised state and fuel delivery means controls the flow of the pressurised natural gas into the second variable volume chamber without use of pumping means. The engine is made simple by the fact that no pump is needed. The engine is made simple and light and can be used for instance to provide enough power to drive a television and lights. Bottled natural gas is widely available. The burning of natural gas solves lots of emission problems, because natural gas burns very efficiently in air without leaving difficult problems of emissions. Indeed it is envisioned that the engine of the present invention will run without any need for treatment of the exhaust gases, for instance without the need of a catalytic converter.

Preferably the inlet valve means comprises a one-way valve, the transfer valve means comprises a port cyclically opened and closed during motion of the reciprocating member and the exhaust valve means comprises a port cyclically opened and closed during motion of the reciprocating member. More preferably, the transfer valve means comprises a first transfer valve which can be opened in the first variable volume chamber and a second transfer port which can be opened in the second variable volume chamber and conduit means extending through the reciprocating member to connect the first and second transfer ports.

The first transfer port is devised in an inwardly facing surface of an end section wall of an open ended cylinder of the reciprocating member and the second transfer port is provided in an inwardly facing surface of an end section wall of the other open ended cylinder of the reciprocating member.

The present invention provides a simple construction wherein the flow of gases passes actually through the reciprocating member itself rather than through the housing surrounding the reciprocating member. This is a novel approach to the passage of gases.

As mentioned above, it is preferable that a first piston portion of the housing extends in a first of the open-ended cylinders and opens and closes the first transfer port present in the first open ended cylinder during reciprocation of the reciprocating member. It is also preferable that a second piston portion of the housing extends in a second of the open-ended cylinders and acts as a piston in the second open ended cylinder and opens and closes the second transfer port present in the second open ended cylinder during reciprocation of the reciprocating member. Ideally, the exhaust valve means comprises an exhaust port which can be opened in the second variable volume chamber and conduit means extending through the reciprocating member to connect the exhaust port to the fluid outlet. The exhaust port provided will be advantageously provided on the inwardly facing surface of the end section wall of the second open ended cylinder, the exhaust port being located opposite the second transfer port. It is preferred that the second piston portion of the housing controls the opening and closing of the exhaust port by opening and closing the exhaust port during reciprocation of the reciprocating member.

It will be appreciated that the engine is simple in construction, operates on a two-stroke cycle and uses scavenging to remove at least some of the combusted gas to exhaust. The scavenging will permit some exhaust gas recirculation, because some exhaust gases will inevitably remain along with the fresh incoming charge, for subsequent combustion. This may improve the emissions of the engine.

Preferably during each reciprocation of the reciprocating member, the second piston portion of the housing sequentially:

- opens the exhaust port to allow combusted gases to flow from the second variable volume chamber;
- opens the second transfer port to allow admittance of a charge of air into the second variable volume chamber to scavenge combusted gases out of the second variable volume chamber through the exhaust port and to supply air for combustion;
- closes the second transfer port to prevent air being expelled through the transfer port during compression; and
- closes the exhaust port to seal the second variable volume chamber ready for combustion.

Preferably, the second piston portion of the housing which acts as a piston in the second variable volume chamber is provided with a cut-out portion located adjacent the second transfer port when the second transfer port is open which defines a region where combustion is commenced. Preferably, the fuel delivery means delivers fuel to the region of the second variable volume chamber defined by the cut out portion in the second piston portion of the housing.

Preferably the fuel and air mixture is ignited by active radical combustion. Active radical combustion is a new combustion mechanism recognised in the art in which the fuel/air mixture commences combustion spontaneously due to the presence of free radical ions in the mixture along with an elevated pressure and an elevated temperature of the mixture. The free radical ions are most advantageously introduced by the retention of exhaust gases in the mixture and the use of a two-stroke cycle with scavenging actively assists this. Indeed, the scavenging arrangement preferred in the present invention is a well-proven system which gives a well balanced distribution of fuel/air which is very good for auto ignition. The active radical combustion gives stable and clean combustion, particularly when an engine is run at a steady speed. It is envisaged that the very simple engine of the present invention will use active radical combustion with a two-stroke cycle and will operate as a steady state or a reasonably steady state with perhaps a full load condition and a half-load condition.

The machine of the present invention can be provided with a spark ignition means which operates in the region of the second variable volume chamber when ignition is commenced. The spark ignition means can be used either instead of active radical combustion or in combination with active radical combustion. It is preferred that active radical combustion is used alongside spark ignition, because the spark ignition will ensure combustion at a particular time, whilst the active radical combustion will ensure combustion which provides very low levels of $NO_x$ hydrocarbons and carbon monoxide.

Preferably the housing has conduit means passing therethrough which allow cooling air to be drawn from, and expelled to, the atmosphere for passing over and cooling of the reciprocating member. The reciprocating member can itself have cooling passages passing therethrough which allow passage of cooling air through the reciprocating member. Again, the use of air cooling provides a very simple engine, which does not, for instance, require a water pump.

Preferably the engine comprises an electrical winding in the housing surrounding the reciprocating member and the reciprocation of the reciprocating member is used to generate electrical power with the electrical winding being connectable to an electrical load. For instance, the present invention could be used as an engine in a hybrid vehicle. The reciprocating member can generate single phase alternating current. Three-phase alternating current would then be provided by use of an inverter. The present invention integrates the generator into the engine itself by providing an electrical coil in the cylinder liner. The electrical coil is therefore brought very close to the reciprocating member and this aids considerably the efficiency for generators.

The coil is adjacent to the reciprocating member and there is no cylinder liner in between which will attenuate the flux linkage. The clearance between the coil and the reciprocating member can be reduced to perhaps 1/1000 th of an inch, ensuring maximum efficiency of the electrical circuit.

The present invention provides a good combination of engine and generator because essentially the engine is turned inside out, with the what would normally be the cylinder block in fact providing the pistons and what would normally be the piston providing the cylinders. This facilitates a good interaction between the reciprocating member and the coil surroundings.

It is envisaged that the present invention would fill the gap between current technology and fuel cell technology and could provide an immediate hybrid power solution for vehicles, where the delay to produce hybrid vehicles has been in part due to the complexity and cost of existing engines and fuel cell systems. The present engine would also be very useful as a static generator. The generator could be used as a generator for electrical power for electrical actuators in a vehicle which are now more common and which are more efficient and more in place of hydraulic actuators. The combined generator engine in a vehicle could be provided with a socket for outside uses so that the engine could not only provide power for powering electric motors driving a vehicle, but also external power, e.g. of 50 Hz, for powering electrical apparatus used outside the vehicle.

The present invention also provides a use of the machine described above in its operation as an engine in which one machine is used in tandem with a second machine, with the reciprocal members of the first and second machines lying on the same axis of reciprocation and with the reciprocal members of the first and second machines connected to move together and with the timing of both machines chosen so that whilst combusted gases are expanded in one machine a charge of fuel and air is being compressed in the other machine. The coupling of the two pistons together would utilise the combustion of fuel and air mixture in one engine with the subsequent expansion of gases as power for compressing charge air in the other engine.

In a further aspect, the machine of the present invention could also be used as a compressor with the reciprocating member driven to reciprocate by electrical power supplied to the electrical winding of the machine, wherein during reciprocation:

- the charge of gas is drawn into the first variable volume chamber via the fluid inlet;
- a charge of gas drawn into the first variable volume chamber is compressed in the first variable volume chamber;
- the compressed gas is delivered via the transfer valve means to the second variable volume chamber;
- the compressed gas delivered to the second variable volume chamber is compressed further in the second variable volume chamber;
- the compressed gas in the second variable volume chamber is expelled via the outlet means to the outlet.

Preferably the inlet valve means in the compressor embodiment of the invention comprises a first one way valve which allows gas to pass from the fluid inlet into the first variable volume chamber and does not allow gas to pass from the first variable volume chamber out of the fluid inlet, the first one way valve allowing passage of gas from the fluid inlet to the first variable volume chamber only after a pressure differential of a first magnitude is established thereacross.

Preferably the transfer valve means comprises a second one way valve which allows gas to pass from the first variable volume chamber to the second variable volume chamber and which prevents gas flowing from the second variable volume chamber to the first variable volume chamber, the second one way valve allowing passage of gas from the first to the second variable volume chamber only when a pressure differential is established thereacross of a second magnitude.

Preferably the outlet valve means comprises a third one way valve which allows gas to be expelled from the second variable volume chamber to the fluid outlet and prevents gas being drawn into the second variable volume chamber via the fluid outlet, the third one way valve allowing expulsion of gas from the second variable volume chamber only when a pressure differential is established thereacross of a third magnitude.

It will be appreciated that the compressor provided by the invention is a two-stage compressor, with the gas being compressed to a first level of pressure in the first variable volume chamber and the second level of pressure in the second variable volume chamber. Preferably the first, second and third one way valves are spring-biassed valves.

The compressor of the present invention is simple and cheap in construction.

The first variable volume chamber preferably has a cross-section taken perpendicularly of the axis of reciprocation which has a first area and the second variable volume chamber has a cross-section taken radially of the axis of reciprocation which has a second area smaller than the first area. Thus, for a given force on the reciprocating member the pressure applied to gas in the first variable volume chamber is less than the pressure applied to the gas in the second variable volume chamber.

Preferably the housing has a first piston portion which extends into the first variable volume chamber and matches in radial cross-section the first variable volume chamber and the housing has a second piston portion which extends into the second variable volume chamber and matches in radial cross-section the second variable volume chamber.

The present invention achieves its simplicity of construction by reversing the usual arrangement of components. The cylinders are provided by the reciprocating member and the pistons are provided by the static housing.

Preferably the inlet valve means is provided in the first piston portion of the housing and the outlet valve means is provided in the second piston portion. Preferably the transfer valve means is located in the middle section of the reciprocating member.

It is preferred that the second variable volume chamber has a maximum volume smaller than the maximum volume of the first variable volume chamber.

Preferably the engine has control means to control the electrical wave form used to power the electrical winding and thereby control the output of the machine.

Further embodiments of the present invention will now be described with reference to the accompanying drawings, in which.

Figure 1:
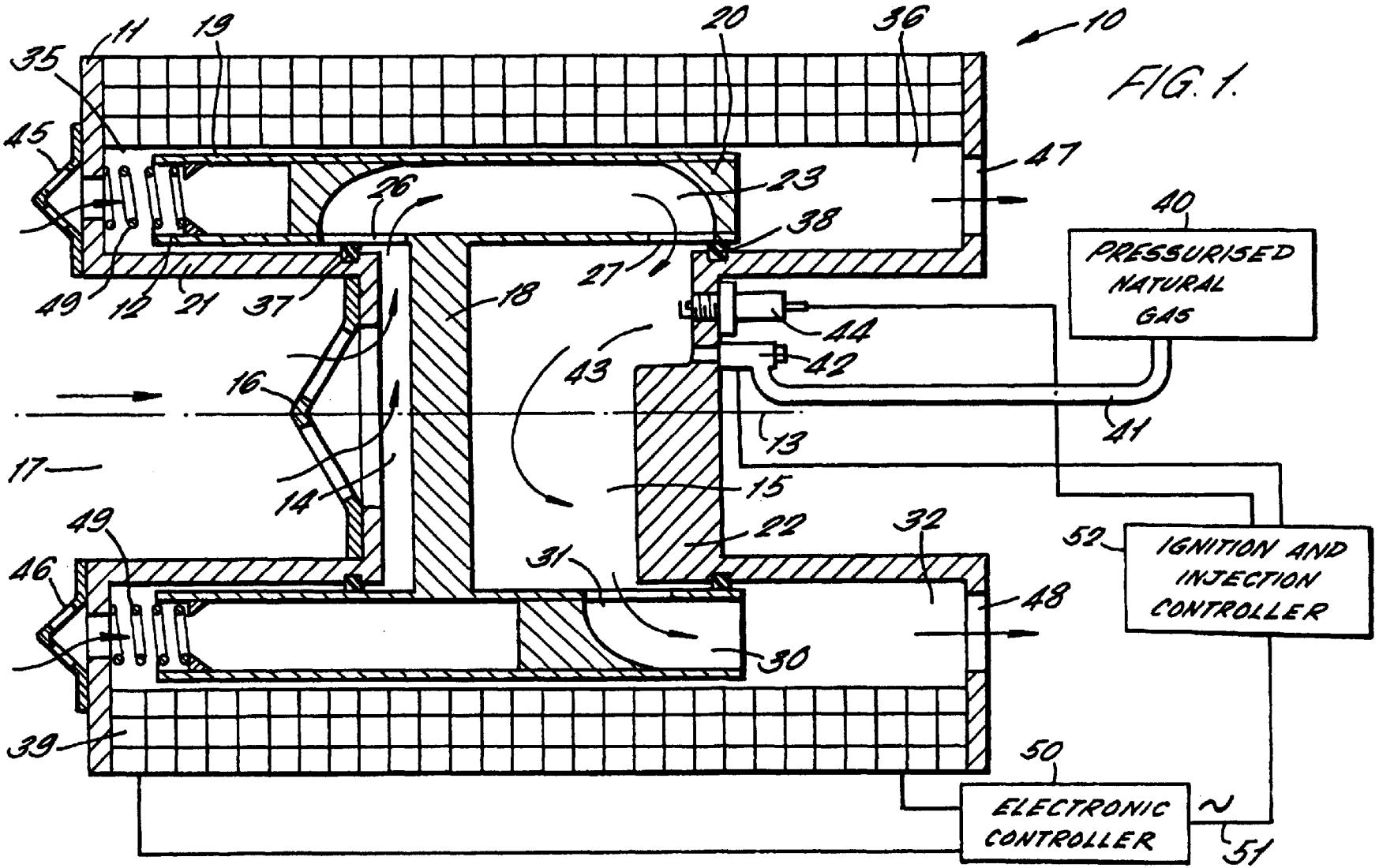
FIG. 1 is a schematic cross-section of an internal combustion engine according to the present invention.

Turning now to FIG. 1, a cyclically operating fluid displacement machine can be seen in the form of an internal combustion engine 10. The internal combustion engine 10 comprises a housing 11 in which there reciprocates a reciprocating member 12. The reciprocating member 12 is reciprocal linearly along an axis of reciprocation 13 in the housing 11. The reciprocating member 12 defines with the housing 11 a first variable volume chamber 14 and a second variable volume chamber 15.

An inlet valve 16 in the form of a one-way spring biassed valve allows air to be drawn from air inlet 17 into the first variable volume chamber 14 and prevents flow of air from the first variable volume chamber 14 out of the air inlet 17.

The reciprocating member 12 comprises a middle section 18 which extends perpendicularly of the axis of reciprocation 13. The reciprocating member 12 also comprises two end sections 19 and 20 on opposite sides of the middle section 18. Each of the end sections 19 and 20 comprises a wall extending generally parallel to the axis of reciprocation 13. Each of the end sections 19 and 20 defines with the middle section 18 an open-ended cylinder open at one end. The housing 11 has a first piston portion 21 which extends into a first of the open-ended cylinders of the reciprocating member 12 and which acts as a piston in the open-ended cylinder formed by the end-section 19. The first piston portion 21 and the first open-ended cylinder formed by the end section 19 together define the first variable volume chamber 14.

The housing 11 has a second piston portion 22 which extends into the open ended cylinder defined by the end-section 20 and which acts as a piston in the open-ended cylinder defined by the end section 20. The second piston portion 22 and the open ended cylinder formed by the end section 20 together define the second variable volume chamber 15. Transfer of gas from the first variable volume chamber 14 to the second variable volume chamber 15 is permitted by three conduits 23, 24 and 25 (see FIG. 2). Each conduit 23, 24, 25 runs from a transfer port which can open onto the first variable volume chamber 14 to a transfer port which can open onto a second variable volume chamber 15. For instance, as can be seen in FIG. 1, the conduit 23 runs from a transfer port 26 which can open onto the variable volume chamber 14 to a transfer port 27 which can open onto the variable volume chamber 15. The transfer ports 26 and 27 are closed when they are aligned with and are covered respectively by the piston portions 21 and 22 of the housing 11. The transfer ports 26 and 27 are open when they are not aligned with and are not covered respectively by the piston portions 21 and 22.

A conduit 30 extends through the reciprocating member 12 and connects an exhaust port 31 openable in the variable volume chamber 15 with an exhaust 32 of the engine 10. The exhaust port 31 is located diametrically opposite the transfer ports 27, 33 and 34, as can be seen in FIG. 2.

Figure 2:
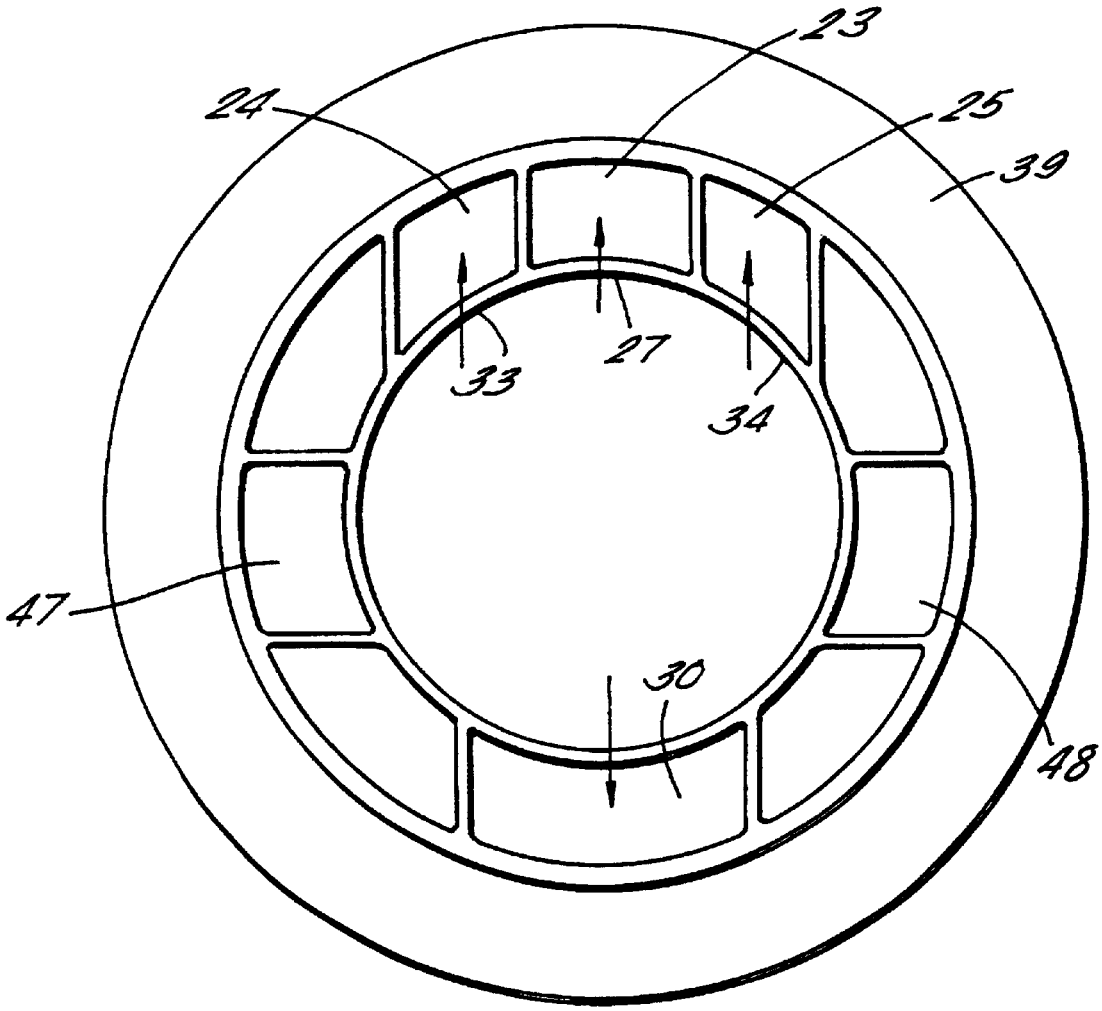
FIG. 2 is a schematic cross-section taken through the internal combustion engine of FIG. 1.

It can also be seen in FIG. 2 that the reciprocating member 12 has a circular radial cross-section. The end sections 19 and 20 of the reciprocating member 12 comprise each an annular wall spaced from the central axis of the reciprocating member 12, which is coincident with the axis of reciprocation 13. Each of the end section annular walls 19 and 20 are slidable in annular slots provided in the housing 11. Two annular slots 35 and 36 are provided one at each end of the housing 11. An annular ring seal 37 acts between the end section 19 and the slots 35 and an annular ring seal 38 acts between the slot 36 and the end section 20.

An electrical winding 39 is provided in the housing 11 wound around the reciprocating member 12. The electrical winding 39 is annular in nature and extends parallel to and adjacent to the cylindrical outermost surface of the reciprocating member 12. The annular electrical winding 39 extends parallel to the axis of reciprocation 13 and has a length equivalent to at least the sum of the axial length of the reciprocating member 12 and the distance travelled by the reciprocating member 12 during each reciprocation.

The engine 10 uses compressed natural gas as a fuel. The compressed natural gas is contained in a pressurised container 40 which is connected by a pipe 41 to a gas injector 42. The gas injector 42 regulates the flow of compressed natural gas into the second variable volume chamber 15, but the engine 10 does not include any pumping means for the fuel, instead relying upon the pressure of the pressurised gas itself.

The second piston portion 22 of the housing 11 is provided with a cut out portion 43 which is located adjacent the transfer ports 27,33 and 34 when the transfer ports 27, 33 and 34 are open, i.e. the reciprocating member 12 is in its position shown in FIG. 1, i.e. displaced to the left, with the volume of the second variable volume chamber 15 at or close to maximum volume and the volume of the first variable volume chamber 14 at or close to its minimum volume. The cut out portion 43 defines a region in the second variable volume chamber 15 in which combustion is commenced. A spark plug 44 is provided to operate in the region 43.

The housing 11 is provided with cooling air inlets such as 45 and 46. These cooling air inlets 45 and 46 as shown are valved inlets, permitting cooling air to be drawn into the housing 11, but not expelled from the housing 11. Instead, cooling air outlets 77 and 78 are provided at the other end of the housing 11. Cooling air ducts 47 and 48 extend linearly along the length of the reciprocating member 12. As the reciprocating member 12 reciprocates, cooling air is drawn in through the cooling air inlets 45 and 46, passed through the cooling air ducts 47 and 48 and expelled through the cooling air outlets 77 and 78. In fact, the cooling air exhausted through the outlet 78 is mixed with exhaust gases passing through the exhaust 32.

In operation of the engine shown in FIGS. 1 and 2 a charge of air is drawn into the first variable volume chamber 14 via the fluid inlet 17 and via the one way inlet valve 16. The air is drawn into the first variable volume chamber 14 as the first variable volume chamber 14 increases in volume, i.e. when the reciprocating member 12 moves to the right of its position in FIG. 1. As the reciprocating member 12 moves to increase the volume of the first variable volume chamber 14, a pressure differential is established across the one-way inlet valve 16 which allows admission of air into the first variable volume chamber 14. Air continues to be drawn into the chamber 14 until the chamber 14 reaches its maximum volume. At this point the one way valve 16 closes and the reciprocating member 12 acts to reduce the volume of the chamber 14.

The transfer port 26 is open throughout all or the majority of travel of the reciprocating member 12. As the reciprocating member 12 acts to reduce the volume of the chamber 14, the air in the chamber 14 is compressed and also displaced through the transfer port 26 into the conduits 23, 24 and 25. Initially as the reciprocating member 12 acts to reduce the volume of the chamber 14, the transfer ports 27, 33 and 34 are not open to the chamber 15, because they are sealed by the piston portion 22 of the housing 11. As the chamber 14 reaches its minimum volume and the chamber 15 reaches it maximum volume, the transfer ports 23, 24 and 25 become uncovered and the compressed air flows into the chamber 15 and scavenges from the chamber 15 combusted gases out through the exhaust port 31 to the exhaust 32. The air admitted via the transfer ports 27,33 and 34 also forms fresh charge air for the engine 10.

Once the chamber 15 has reached its maximum volume then the direction of motion of the reciprocating member 12 will change and the reciprocating member 12 will act to reduce the volume of the chamber 15 and increase the volume of the chamber 14. The transfer ports 27, 33 and 34 are then covered and closed by the peripheral surface of the piston portion 22. The exhaust port 31 is subsequently closed by the piston portion 22. The chamber 15 is then closed and the air in the chamber 15 becomes compressed as the reciprocating member 12 moves to reduce the volume of the chamber 15.

Either when the exhaust port 31 is closed, or shortly before the exhaust port 31 becomes closed, pressurised gas is admitted to the chamber 15. The injector 42 controls the admission of pressurised gas.

The mixture of gas and air in the chamber 15 is compressed after the exhaust port 31 is closed by the reduction in volume of the chamber 15. At or about the point where the volume of the chamber 15 is at its minimum, the spark plug 44 sparks and ignites the gas and air mixture. The combusted gas and air mixture then expands and forces the reciprocating member 12 to move as the volume of the chamber 15 increases. Eventually, the exhaust port 31 is uncovered and the expanding combusted gases can escape to the exhaust 32. The combusted gases are scavenged by the next charge of air admitted to the transfer ports 27, 33 and 34 and the whole cycle begins again.

The fuel/air mixture present in the chamber 15 before combustion will contain some exhaust gas and this is preferred. It is preferred because the exhaust gas will contain radical ions and will enable combustion of the fuel/air mixture by active radical combustion. Active radical combustion is known in the art and will not be explained in detail in the specification. In the preferred embodiment, active radical combustion occurs in parallel with combustion using spark ignition.

In the FIG. 1 embodiment of the invention the engine 10 comprises a spring 49 which acts between the housing 11 and the reciprocating member 12 to bias a reciprocating member 12 into a position where the chamber 15 has minimum volume and the chamber 14 has maximum volume. In this arrangement, after the combusted gases in chamber 15 have expanded, the spring 49 uses stored energy to return the reciprocating member 12 to a position in which the chamber 14 has maximum volume and the chamber 15 minimum volume.

The reciprocation of the reciprocating member 12 will generate electricity by means of the electrical winding 39. The electrical winding 39 is connected to an electronic controller 50 which generates an alternating current sinusoidal waveform on the line 51. The line 51 is connected to an electrical load. The line 51 is also connected to an electronic controller 52 which controls the ignition of the spark plug 44 and controls injection of pressurised gas by the injector 42. The controller 52 can determine the position of the reciprocating member 12 relative to the housing 11 from the signal on the line 51.

Figure 3:
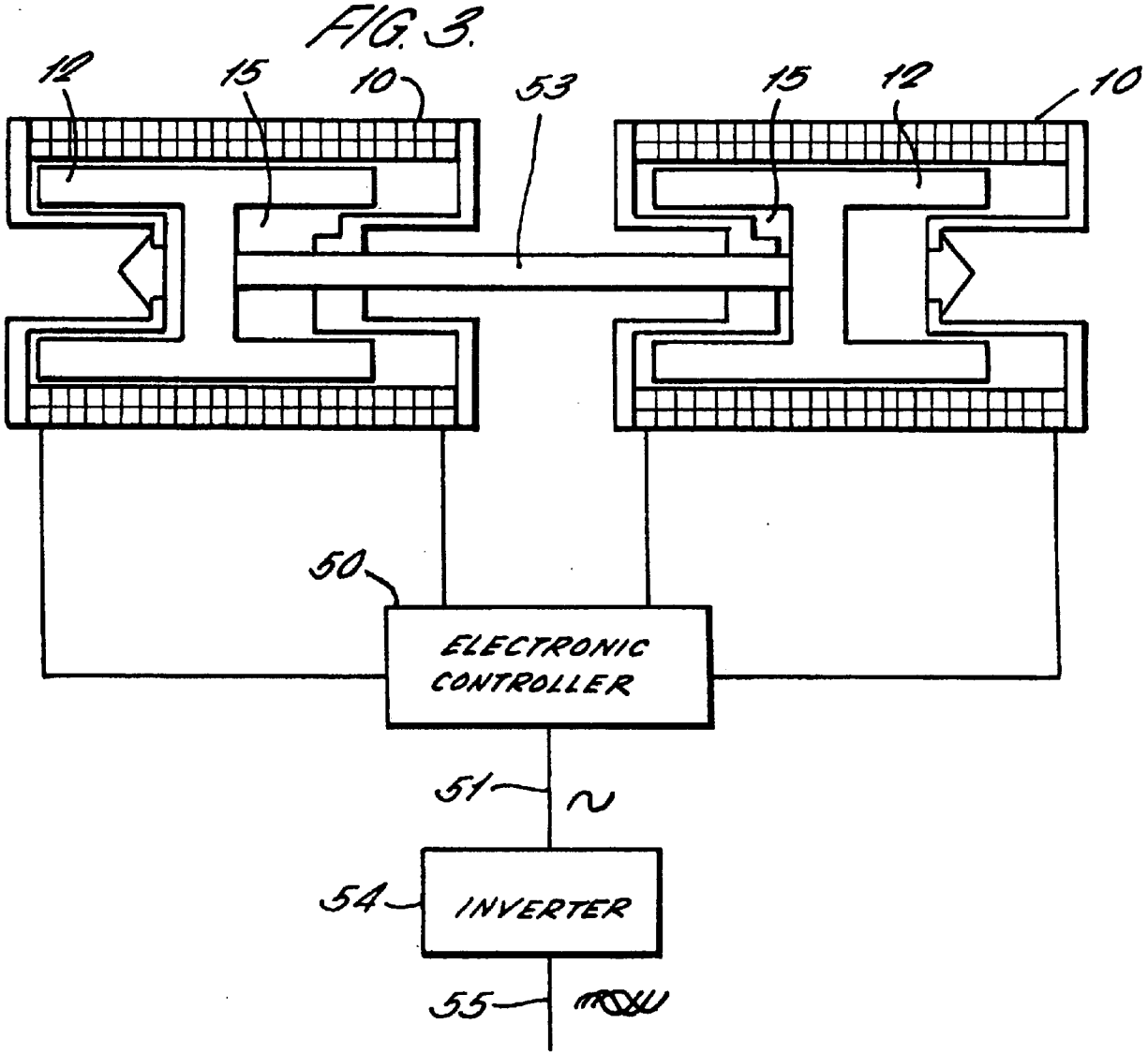
FIG. 3 is a schematic representation of a combined pair of the internal combustion engines illustrated in FIGS. 1 and 2.

Rather than using a spring such as spring 49, it is envisaged that two engines 10 can be used in tandem as illustrated in FIG. 3. It can be seen in FIG. 3 that the second variable volume chamber 15 of one of the engines 10 has its maximum volume when the second variable volume chamber 15 of the other engine 10 has its minimum volume. The two reciprocating members 12 are connected by a connecting rod 53. The expansion of the combusted gases in one of the engines 10 will cause both of the reciprocating members 12 in both engines 10 to move. In the arrangement shown, there will always be expansion of combusted gases in one of the engines so that there will always be an expanding force acting to move the reciprocating members 12. The expansion of combusted gases in one of the engines 10 acts to move the reciprocating members 12 in one direction and the expansion of the combusted gas in the other engine 10 acts to move the reciprocating members 12 in the opposite direction.

It can be seen in FIG. 3 that the controller 50 is common to both engines 10 and the line 51 is connected to an inverter 54 which produces three-phase alternating current on the line 55.

It will be appreciated from the above that the engine of the present invention provides a combined engine and electrical generator, suitable for use in, for instance, a hybrid electrical vehicle. In such a case, the engine would be connected to a combination of batteries and electric motors and would power the electric motors and/or generate electricity for storing in the batteries. It is also possible that the output line could be connected to a load outside of the vehicle, to power other electrical devices.

The engine 10 of the present invention can be designed to work at a specific frequency, which will be the natural frequency of the engine. The engine is designed to work in a steady state condition or perhaps in two different steady state conditions. The interaction of the reciprocating member 12 and the surrounding electrical winding 39 can allow some control of reciprocation of the reciprocating member 12 by use of the electrical controller 50. The frequency of reciprocation of the reciprocating member 12 and/or the amplitude of reciprocal movement can be varied to vary the current output. The current will be proportional to a maximum velocity of the reciprocating member 12.

It is envisaged that the induction coil 39 will comprise enamelled wire.

The engine 10 described above can be started using the coil 39 powered by an electrical source such as a battery. The controller 50 can be used to energise the coil 39 in order to start the reciprocation of the reciprocating member 12. Once the reciprocating member 12 has started reciprocation then the controller 52 will start injection of pressurised gas and ignition of the spark plug 44. Timed opposing forces will be applied on the reciprocating member 12 under the control of the controller 50 during starting. The two coils of the two engines 10 of the FIG. 3 arrangement will be controlled in tandem during starting in the FIG. 3 arrangement. In other words, the coil 39 is used as part of an electrical motor to start the motion of the reciprocating member as well as a generator in extracting power from the engine. Typically the reciprocating member will be reciprocated three or four times before combustion is initiated.

It is envisaged that the coil 39 can be used in place of or in parallel with a spring such as 49 to apply an electromagnetic force which acts to reduce the volume of the chamber 15 and compress the charge therein. Electrical power would be supplied to the coil 39 to enable this to happen. As long as on average the power needed by the coil 39 to effect compression of the fuel/air charge is less than the power extracted by the coil from motion of the reciprocating member caused by expansion of combusted gases, the engine will produce electrical power. The coil can in effect act as an electrical equivalent to a flywheel. Use of a coil as the sole means of effecting compression of a fuel/air charge (without help of a spring) can be beneficial in ensuring accurate control of position of reciprocating member 12.

The engine 10 can be operated in such a way that during operation the reciprocating member 12 can be held stationary for a pause of a controllable duration, under the control of an electromagnetic force applied by coil 39. For instance, the reciprocating member 12 could be held in a position in which the exhaust port 31 has just been closed. The coil 39 could then, after a pause, apply an electromagnetic force to compress the fuel/air charge in the chamber 15 and operation could start again. The use of periodically occurring variable length pauses could be used to vary the power output of the engine in place of a change of rate of reciprocation of the reciprocating member 12 since it is preferred that the reciprocating member 12 when reciprocating does so at a constant optimum rate.

It will be appreciated that the engine above provides a very simple construction engine of light weight and low cost. The engine effectively has a single moving part, the reciprocating member 12. The engine does not need complicated valving arrangements or cam shafts to drive such valves.

Figure 4:
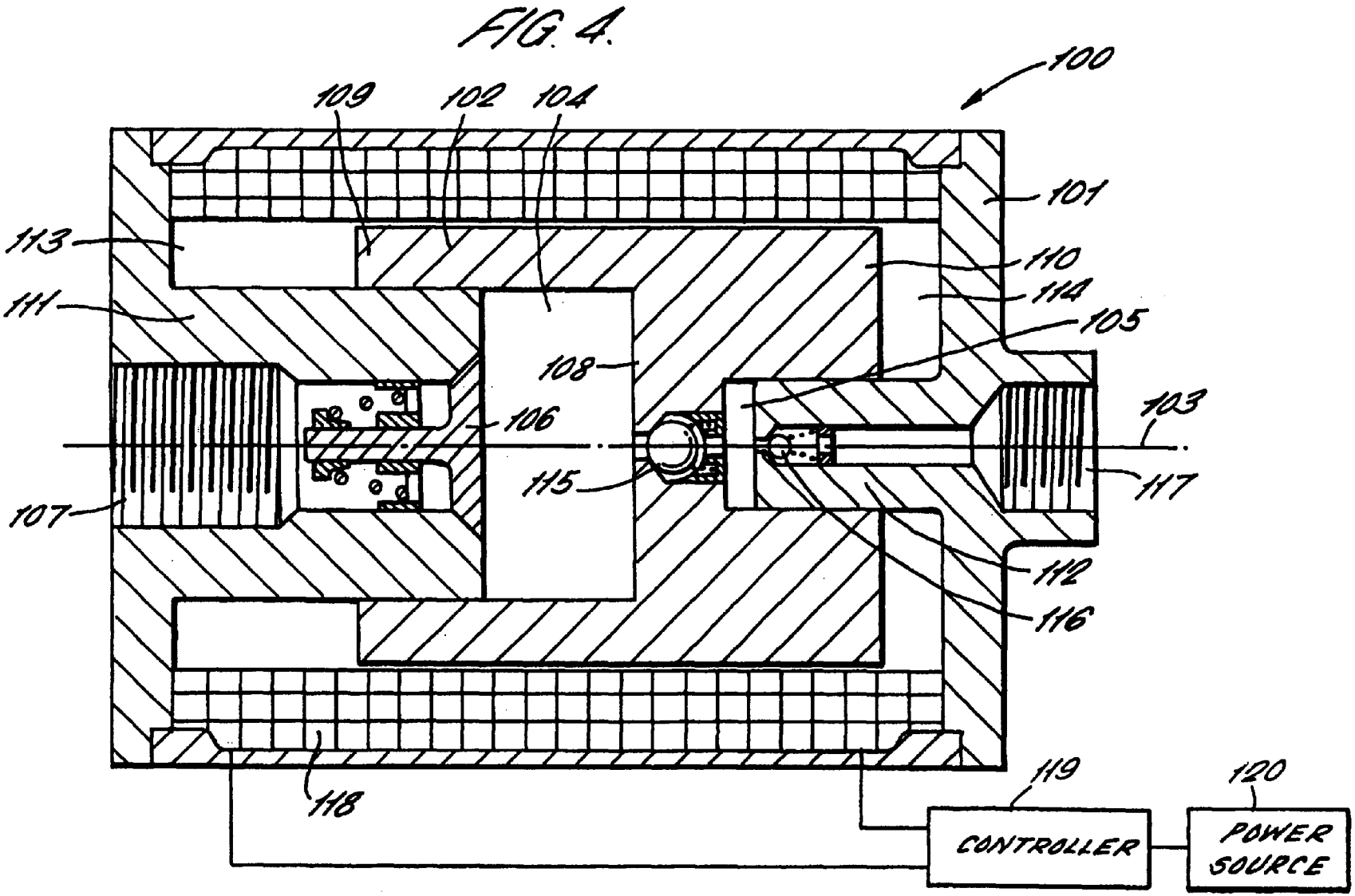
FIG. 4 is a schematic cross-section taken through a compressor according to the present invention.

The cyclically operated fluid displacement machine of the present invention can also provide a compressor and an example of this is shown in FIG. 4. In FIG. 4 a compressor 100 is shown to comprise a housing 101 in which reciprocates a reciprocating member 102. The reciprocating member 102 is reciprocal along an axis of reciprocation 103. The reciprocating member 102 defines with the housing 101 a first variable volume chamber 104 and a second variable volume chamber 105. The first variable volume chamber 104 has a cross-section taken radially of the axis of reciprocation 13 which has a first area and the second variable volume chamber 105 has a cross-section taken radially of the axis of reciprocation 103 which has a second area smaller than the first area. The second variable volume chamber 105 has a maximum volume smaller than the maximum volume of the first variable volume chamber 104. A one-way inlet valve 106 allows flow of gas from a gas inlet 107 into the first variable volume chamber 104, but does not allow gas to pass from the variable volume chamber 104 out of the gas inlet 107. The one way inlet valve 106 is spring-biassed and only allows gas to flow from the gas inlet 107 into the first variable volume chamber 104 when a pressure differential of a first magnitude is established thereacross. The reciprocating member 102 comprises a middle section 108 which extends perpendicularly of the axis of reciprocation 103. The reciprocating member 102 has two end sections 109 and 110 on opposite sides of the middle section 108. The end sections 109, 110 comprise walls extending generally parallel to the axis of reciprocation 103. Each end section 109, 110 defines with the middle section 108 an open ended cylinder, open at one end. The housing 101 has a first piston portion 111 which extends into the open ended cylinder defined in part by the end section 109. The piston portion 111 acts as a piston in the open ended cylinder defined in part by the end section 109. The first piston portion 111 and the open ended cylinder defined in part by the end section 109 together define the first variable volume chamber 104.

A second piston portion 112 extends into the open ended cylinder defined in part by the wall 110. The piston portion 112 acts as a piston in the open ended cylinder defined in part by the end section 110 and the open ended cylinder and the piston portion 112 together define a second variable volume chamber 105.

The reciprocating member 102 has a generally circular radial cross-section and the end sections 109 and 110 each comprise an annular wall spaced from the central axis of the reciprocating member 102 which is coincident with the axis of reciprocation 103. The end section walls 109 and 110 are slidable in two annular slots 113 and 114 provided at opposite ends of the housing 101. A transfer one-way valve 115 which is spring biassed is provided in the middle section 108 of the reciprocating member 102. The valve 115 allows gas to pass from the chamber 104 to the chamber 105 but does not allow gas to pass from the chamber 105 back to the chamber 104. The valve 115 is spring-biassed and only allows gas to pass from the chamber 104 to the chamber 105 when a pressure differential is established thereacross which is of a second magnitude.

A third one-way valve 116 which is also spring-biassed is provided in the piston portion 112 and allows gas to be expelled from the chamber 105 to a gas outlet 117. The one-way valve 116 allows gas to be expelled from the chamber 105 to the outlet 117 but does not allow gas to be drawn into the chamber 105 from the outlet 117. The valve 116 is spring-biassed to allow gas to be expelled from the chamber 105 to the outlet 117 only when a pressure differential is established thereacross of a third magnitude.

An annular electrical winding 118 surrounds the reciprocating member 112 and extends parallel to and is adjacent to the outwardly facing cylindrical surface of the reciprocating member 102. The electrical winding 118 extends parallel to the axis of reciprocation 103 and has a length equivalent to at least the sum of the axial length of the reciprocating member 102 and the distance travelled by the reciprocating member 102 in each reciprocation.

The electrical winding 118 is connected to a controller 119 which is connected to the source of electrical power 120. The controller 119 supplies to the coil 118 an electrical waveform controlled in such a way that the reciprocating member 102 is forced first one way and then the opposite way, in a timed fashion. The reciprocating member 102 is preferably caused to reciprocate back and forth at a frequency set by the electrical waveform supplied by the controller 119.

Starting with the volume of the chamber 104 at its minimum, the reciprocating member will be forced by the electromagnetic force applied by the coil 118 to increase the volume of the chamber 104. This increasing in volume will establish a pressure differential across the inlet valve 106 and when this pressure differential is greater than the first magnitude mentioned above, the inlet valve 106 will open to allow gas to be drawn in from the gas inlet 107 into the chamber 104. Once the chamber 104 reaches its maximum volume then the one way valve 106 will close and the reciprocating member 102 will be forced by the magnetic force to reduce in volume the chamber 104. The gas in the chamber 104 will therefore be compressed. When the pressure of the compressed gas in the chamber 104 exceeds a second magnitude (mentioned above) the one way valve 115 will open and will allow gas to flow from the chamber 104 into the chamber 105 (which increases in size as the chamber 104 decreases in size). When the chamber 105 reaches its maximum volume and the chamber 104 reaches its minimum volume, then the one way valve 115 will close and the reciprocating member 102 will be forced again to increase the volume of the chamber 104 (drawing in gas as previously described) whilst at the same time reducing in volume the chamber 105. Since the chamber 105 is a of a reduced cross-sectional area, the force on the reciprocating member 102 will result in a greater pressure being applied to the gas compressed in chamber 105. The gas compressed in chamber 105 is compressed until the pressure differential across the valve 116 reaches the third magnitude, at which point the valve 116 opens and allows the gas compressed in chamber 105 to escape via the gas outlet 117.

It will be appreciated that the compressor 100 provided by the invention is a two stage compressor of very simple construction. The output of the compressor can be controlled simply by controlling the electrical wave form used to power the electrical winding 118.

The construction of the compressor 100 is unusual in that the pistons are part of the static housing whilst the cylinders are part of a reciprocating member. This construction makes good use of the flux linkage between the annular electrical winding 118 and the reciprocating member 102, which is located adjacent to the electrical winding 118. The two stage compressor is effectively a single moving part machine.

Whilst above the open ended cylinders defined by the reciprocating member are circular in cross-section, it should be appreciated that the open ended cylinders could be of any cross-section and the use of the term "cylinder" should not require a circular cross-section but could include, for instance, a square cross-section, an oval cross-section, a rectangular cross-section or whatever shaped cross-section is most convenient.

Whilst in the engine 10 mentioned above the transfer ports, e.g. 26 are closed by the piston 21 when the chamber 14 is at minimum volume, the transfer ports opening onto the chamber 14 could be permanently open to the chamber 14 since control of transfer between chambers 14 and 15 is governed by the transfer ports 27, 33 and 34 which open onto the chamber 15.

In the compressor 100 or the engine 10 mentioned above the reciprocating member 12, 102 could be of steel with good magnetic properties. Alternatively, a coil could be provided within the reciprocating member 12, 102 for instance to allow the use of a lighter member. A current could be run through (or induced in) such a coil to improve the performance of the machine.

What is claimed is:

1. A cyclically operating fluid displacement machine which comprises:

a housing;

a reciprocating member reciprocable linearly along an axis of reciprocation in the housing and defining with the housing first and second variable volume chambers;

a fluid inlet connected to the first variable volume chamber;

a fluid outlet connected to the second variable volume chamber;

inlet valve means which allows flow of fluid through the fluid inlet into the first variable volume chamber and which prevents flow of fluid from the first variable volume chamber out of the fluid inlet;

transfer valve means which allows flow of fluid from the first variable volume chamber to the second variable volume chamber and which prevents flow of fluid from the second variable volume chamber to the first variable volume chamber; and outlet valve means which allows flow of fluid from the second variable volume chamber out of the fluid outlet and which prevents flow of fluid from the fluid outlet into the second variable volume chamber; wherein:

during movement of the reciprocating member in the housing in a first direction fluid is drawn into the first variable volume chamber and fluid in the second variable volume chamber is expelled from the second variable volume chamber via the fluid outlet;

during movement of the reciprocating member in the housing in a second direction opposite to the first direction fluid is compressed in the first variable volume chamber and fluid is transferred from the first variable volume chamber via the transfer valve means to the second variable volume chamber;

the reciprocating member comprises a middle section which extends perpendicularly of the axis of reciprocation and two end sections on opposite sides of the middle section each of the end sections comprising a wall extending generally parallel to the axis of reciprocation and each of the end sections defining with the middle section an open-ended cylinder open at one end;

the housing has a first piston portion which extends into a first of the open-ended cylinders of the reciprocating member and which acts as a piston in the first open-ended cylinder with the first piston portion and the first open-ended cylinder together defining the first variable volume chamber; and the housing has a second piston portion which extends into a second of the open-ended cylinders of the reciprocating member and which acts as a piston in the second open-ended cylinder with the second piston portion and the second open-ended cylinder together defining the second variable volume chamber;

characterized in that:

the machine further comprises an electrical winding provided in the housing surrounding the reciprocating member, the electrical winding extending parallel to and adjacent to the end section walls of the reciprocating member.

2. A machine as claimed in claim 1 wherein the reciprocating member has a generally circular radial cross-section and the end sections each comprise an annular wall spaced from a central axis of the reciprocating member.

3. A machine as claimed in claim 1 wherein the electrical winding extends parallel to the axis of the reciprocation of the reciprocating member and has a length equivalent at least to the sum of the axial length of the reciprocating member and the distance travelled by the reciprocating member in each reciprocation.

4. A machine as claimed in claim 3 in which the end section walls of the reciprocating member are slidable in slots defined in the housing and the electrical winding in the housing extends adjacent to and parallel with surfaces defining the slots.

5. A machine as claimed in claim 4 in which a seal is formed between the end sections of the reciprocating member and the slots in which the end section slides.

6. A machine as claimed in claim 5 wherein resilient means acts between the housing and the reciprocating member to bias the reciprocating member to move in one direction.

7. A machine as claimed in claim 6 wherein the resilient means acts to bias the reciprocating member to reduce the second variable volume chamber to a minimum value.

8. A machine as claimed in claim 1 wherein each of the inlet valve means, the outlet valve means and the transfer valve means comprises either a one-way valve which opens and closes under the action of a pressure differential thereacross or a ported valve comprising a port opening onto one of the variable volume chambers which is cyclically opened and closed by the reciprocating member during reciprocation.

9. A machine as claimed in claim 8 in which the inlet valve means comprises a spring-biased one way valve.

10. A machine as claimed in claim 1 which functions as an internal combustion engine wherein:

a charge of air is drawn into the first variable volume chamber via the fluid inlet;

the charge of air drawn into the first variable volume chamber is compressed;

the compressed charge of air is delivered via the transfer valve means to the second variable volume chamber;

the machine comprises fuel delivery means which delivers fuel to the second variable volume chamber for mixing with the compressed charge of air;

the compressed charge mixture of fuel and air is combusted and allowed to expand in the second variable volume chamber; and the expanded combusted mixture is scavenged from the second variable volume chamber by a subsequent charge of air delivered to the second variable volume chamber via the transfer valve means.

11. A machine as claimed in claim 10 wherein the fuel used is compressed natural gas and the machine comprises storage means for storing the natural gas in a pressurised state and wherein the fuel delivery means controls flow of the pressurised natural gas into the second variable volume chamber without use of pumping means.

12. A machine as claimed in claim 10 wherein the inlet valve means comprises a one-way valve, the transfer valve means comprises a port cyclically opened and closed during motion of the reciprocating member and the exhaust valve means comprises a port cyclically opened and closed during motion of the reciprocating member.

13. A machine as claimed in claim 12 wherein the transfer valve means comprise a first transfer port which can be opened in the first variable volume chamber and a second transfer port which can be opened in the second variable volume chamber and conduit means extending through the reciprocating member to connect the first and second transfer ports.

14. A machine as claimed in claim 13 wherein the first transfer port is provided in an inwardly facing surface of an end section wall of one open-ended cylinder of the reciprocating member and the second transfer port is provided in an inwardly facing surface of an end section wall of the other open-ended cylinder of the reciprocating member.

15. A machine as claimed in claim 14 wherein the first piston portion of the housing opens and closes the first transfer port present in the first open-ended cylinder during reciprocation of the reciprocating member and wherein the second piston portion of the housing and opens and closes the second transfer port present in the second open-ended cylinder during reciprocation of the reciprocating member.

16. A machine as claimed in claim 12 wherein the exhaust valve means comprise an exhaust port which can be opened in the second variable volume chamber and conduit means extending through the reciprocating member to connect the exhaust port to the fluid outlet.

17. A machine as claimed in claim 16 wherein the exhaust port provided on the inwardly facing surface of the end section wall of the second open-ended cylinder, the exhaust port being located opposite the second transfer port.

18. A machine as claimed in claim 17 wherein the second piston portion of the housing opens and closes the exhaust port during reciprocation of the reciprocating member.

19. A machine as claimed in claim 18 wherein during each reciprocation of the reciprocating member the second piston portion of the housing sequentially:

opens the exhaust port to allow combusted gases to flow from the second variable volume chamber;

opens the second transfer port to allow admittance of a charge of air into the second variable volume chamber to scavenge combusted gases out of the second variable volume chamber through the exhaust port to supply air for combustion;

closes the second transfer port to prevent air being expelled through the transfer port during compression; and closes the exhaust port to seal the second variable volume chamber ready for combustion.

20. A machine as claimed in claim 18 wherein the second piston portion of the housing is provided with a cut-out portion located adjacent the second transfer port when the second transfer port is open which defines a region wherein combustion is commenced.

21. A machine as claimed in claim 20 wherein the fuel delivery means delivers fuel to the region of the second variable volume chamber defined by the cut-out portion in the second piston portion of the housing.

22. A machine as claimed in claim 21 wherein a spark ignition means is provided to operate in the region of the second variable volume chamber wherein combustion is commenced to ignite the compressed fuel and air mixture.

23. A machine as claimed in claim 10 wherein the housing has conduit means passing therethrough which allow cooling air to be drawn from and expelled to the atmosphere for passing over and cooling of the reciprocating member.

24. A machine as claimed in claim 23 wherein the reciprocating member has cooling passages passing therethrough which allow passage of cooling air through the reciprocating member.

25. Use of a first machine as claimed in claim 10 in tandem with a second machine as claimed in claim 10 with the reciprocable members of the first and second machines lying on the same axis of reciprocation and with the reciprocable members of the first and second machines connected to move together and with the timing of both machines chosen so that whilst combusted gases are expanding in one machine a charge of fuel and air is being compressed in the other machine.

26. A machine as claimed in claim 1, which functions as a compressor with the reciprocating member driven to reciprocate by electrical power supplied to the electrical winding, wherein during reciprocation:

a charge of gas is drawn into the first variable volume chamber via the fluid inlet;

the charge of gas drawn into the first variable volume chamber is compressed in the first variable volume chamber;

the compressed gas is delivered via the transfer valve means to the second variable volume chamber;

the compressed gas delivered to the second variable volume chamber is compressed further in the second variable volume chamber; and the compressed gas in the second variable volume chamber is expelled via the outlet valve means to the outlet.

27. A machine as claimed in claim 26 wherein the inlet valve means comprises a first one-way valve which allows gas to pass from the fluid inlet into the first variable volume chamber and does not allow gas to pass from the first variable volume chamber out of the fluid inlet, the first one way valve allowing passage of gas from the fluid inlet to the first variable chamber only after a pressure differential of a first magnitude is established thereacross.

28. A machine as claimed in claim 27 wherein the transfer valve means comprises a second one way valve which allows gas to pass from the first variable volume chamber to the second variable volume chamber and which prevents gas flowing from the second variable volume chamber to the first variable volume chamber, the second one way valve allowing passage of gas from the first to the second variable volume chamber only when a pressure differential is established thereacross of a second magnitude.

29. A machine as claimed in claim 28 wherein the outlet valve means comprise a third one way valve which allows gas to be expelled from the second variable volume chamber to the fluid outlet and which prevents gas being drawn into the second variable volume chamber via the fluid outlet, the third one way valve allowing expulsion of gas from the second variable volume chamber only when a pressure differential is established thereacross of a third magnitude.

30. A machine as claimed in claim 29 wherein each of the first, second and third one-way valves are spring biassed valves.

31. A machine as claimed in claim 26 wherein the first variable volume chamber has a cross-section taken radially of the axis of reciprocation which has a first area and the second variable volume chamber has a cross-section taken radially of the axis of reciprocation which has a second area smaller than the first area.

32. A machine as claimed in claim 31 wherein the first piston portion matches in radial cross-section the first variable volume chamber and the second piston portion matches in radial cross-section the second variable volume chamber.

33. A machine as claimed in claim 32 wherein the inlet valve means is provided in the first piston portion and the outlet valve means is provided in the second piston portion.

34. A machine as claimed in claim 33 wherein the transfer valve means is located in the middle section of the reciprocating member.

35. A machine as claimed in claim 31 wherein the second variable volume chamber has a maximum volume smaller than the maximum volume of the first variable volume chamber.

36. A machine as claimed in claim 26 wherein the control means is provided to control the electrical waveform used to power the electrical winding and thereby to control output of the machine.

* * * * *